United States Patent [19]

Reynolds

[11] 4,387,753

[45] Jun. 14, 1983

[54] SPLITTING DEVICE WITH VARYING CROSS SECTIONS

[75] Inventor: Michael J. Reynolds, Gladstone, Oreg.

[73] Assignee: Omark Industries, Inc., Portland, Oreg.

[21] Appl. No.: 259,535

[22] Filed: May 1, 1981

[51] Int. Cl.[3] ..... B27L 7/00

[52] U.S. Cl. ..... 144/193 D; 254/104

[58] Field of Search ..... 144/193 R, 193 C, 193 D, 144/193 E; 254/104; 125/23 R; 145/1 R

[56] References Cited

U.S. PATENT DOCUMENTS

| | | | |
|---|---|---|---|
| 759,868 | 5/1904 | Eich | 254/104 |
| 1,209,262 | 12/1916 | Church | 254/104 |
| 1,356,413 | 10/1920 | Staub | 254/104 |
| 1,380,559 | 6/1921 | Jesperson | 144/193 E |
| 1,451,855 | 4/1923 | Wright | 254/104 |
| 4,175,601 | 11/1979 | Meyer | 145/1 R |
| 4,194,544 | 3/1980 | Gibson et al. | 144/193 D |

FOREIGN PATENT DOCUMENTS

| | | | |
|---|---|---|---|
| 1923349 | 11/1970 | Fed. Rep. of Germany | 254/104 |
| 115048 | 9/1945 | Sweden | 254/104 |

*Primary Examiner*—W. D. Bray

*Attorney, Agent, or Firm*—John W. Stuart

[57] ABSTRACT

An elongate unitary splitting device having a lower portion of multiangular configuration with a pair of opposed edges converging at a first angle toward a pointed lower end. An upper portion additionally has a pair of oppositely facing, generally planar side surfaces which intersect and extend upwardly from said edges. The angle between the side surfaces is at least as great as the angle of convergence of the opposed edges. A spear-point configuration provided by the lower end produces ease of startup penetration, and the upper portion produces efficient splitting once initial penetration has occurred.

20 Claims, 7 Drawing Figures

SPLITTING DEVICE WITH VARYING CROSS SECTIONS

BACKGROUND AND SUMMARY OF THE INVENTION

This invention relates to a unitary splitting device having a lower portion which converges to a point and an upper portion having a pair of oppositely facing, generally planar surfaces which diverge at an included angle at least equal to, and preferably greater than, the angle of convergence of the lower portion.

Past splitting devices, such as wedges used for splitting sections of logs, generally have been constructed with a chisel-edged lower end with substantially planar, oppositely facing sides diverging on progressing upwardly from the chisel edge. More recently, a splitting device in the form of a conical-like member has been devised as described in U.S. Pat. No. 4,194,544 to Scott and Gibson. The device of the 4,194,544 patent provides ease of startup penetration, and in the preferred embodiment produces non-directional splitting and cleavage along the line of least resistance in the object. This differs from the present invention which produces more nearly directional splitting which, as tests indicate, requires less total energy input for splitting.

Another pertinent prior art device is illustrated in U.S. Pat. No. 1,380,559 to Jespersen. Jesperson, however, describes a multi-element device which requires that the user begin penetration through striking of two loosely interconnected elements. The user then must remove one of the elements, insert a third element therebetween, and further strike it with the loosely interconnected three elements. The present invention is a decided improvement, in that it is a unitary device which provides ease of startup penetration in the object to be split and produces efficient and effective final splitting without the multi-step procedure required by Jespersen.

A primary object of the present invention is to provide a novel elongate, unitary splitting device having a substantially pointed lower end for ease of initial penetration and production of a cleavage plane in the object to be split and an upper portion having generally planar, oppositely facing diverging surfaces which serve to efficiently split the object after initial cleavage has occurred.

More specifically, an object is to provide such a novel splitting device which has a substantially diamond-shaped cross section in the lower portion thereof converging to a point at the lower end. The device also has an upper portion into which the lower diamond-shaped portion merges, the upper portion having sides with more the configuration of a standard wedge with diverging, substantially planar side surfaces. Such a hybrid design has been found to produce ease of initial penetration, directional cleavage, and effective and efficient completion of splitting through the benefits of diverging planar side surfaces in the upper portion thereof.

Another and more specific object is the provision on such a novel splitting device of gripping means for inhibiting the tendency of such a device to pop out of the object being split.

Drawings

These and other objects and advantages will become more fully apparent as the following description is read in conjunction with the drawings wherein.

Figure 2:
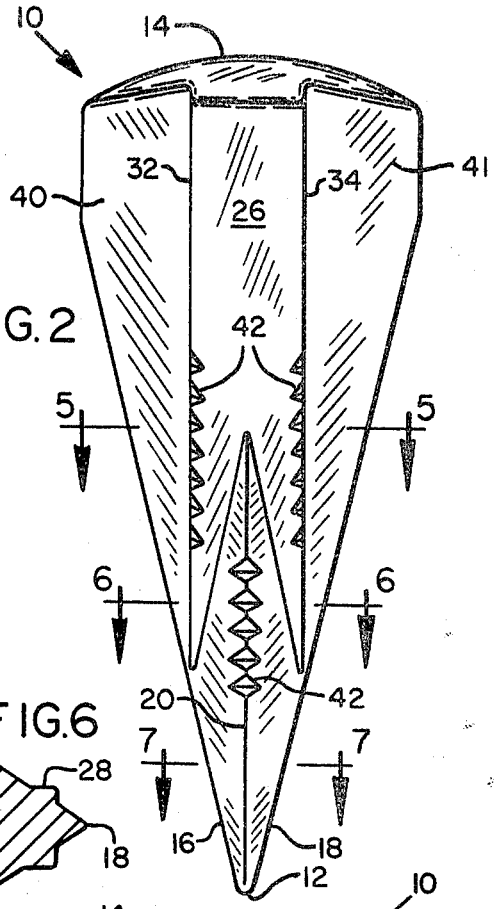
FIG. 2 is an elevation view, on a smaller scale than FIG. 1, illustrating one face of the device.
Figure 6:
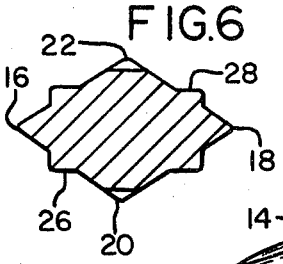
Figure 7:
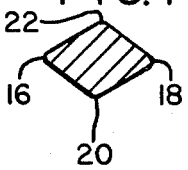
Figure 5:
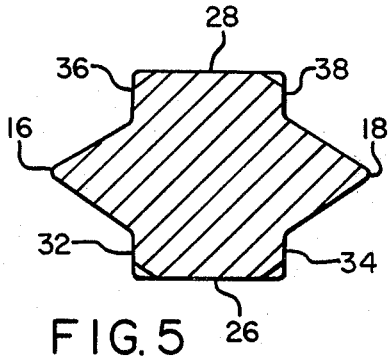
Figure 4:
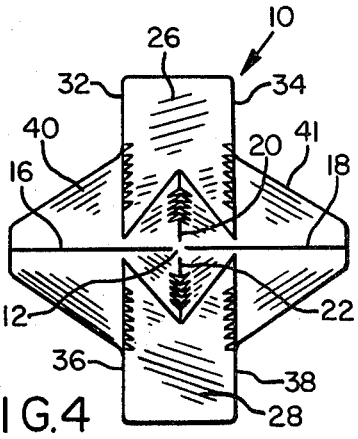
FIG. 4 is a bottom end view of the device.

FIGS. 5, 6 and 7 are enlarged cross sectional views taken generally along the lines 5—5, 6—6, and 7—7 in FIG. 2.

DESCRIPTION OF PREFERRED EMBODIMENT

Referring to the drawings, at 10 is indicated generally a splitting device constructed according to a preferred embodiment of the invention. The lower end extremity of the device forms a point 12 and the upper extremity 14 provides a broad expanse adapted to receive a striking force from an instrument, such as a splitting maul, independent of the device.

Figure 3:
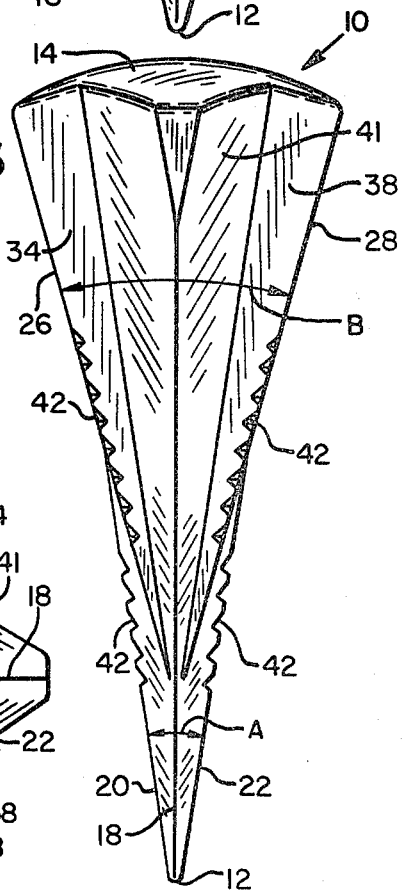
FIG. 3 is an elevation view of one edge of the device, taken at 90° to the view of FIG. 2.

The lower portion adjacent and extending upwardly from the pointed end is multi-angular, as viewed in cross section and, as is best seen in FIG. 7, is substantially diamond-shaped. Such configuration produces opposed edges 16, 18 on its major axis and opposed edges 20, 22 on its minor axis. As is best seen in FIG. 3, opposed edges 20,22 diverge at an angle "A" on progressing upwardly from pointed end 12. The device has been found to work well with this angle of divergence being in a range of 10° to 30°.

The upper portion of the device has a pair of generally planar, oppositely facing side surfaces 26,28. Each of side surfaces 26, 28 is bordered by a pair of substantially parallel, oppositely facing side margins extending longitudinally of the device. Such side margins bordering side surface 26 are noted at 32, 34, and the side margins bordering side surface 28 are noted 36, 38.

Referring to FIG. 3, it will be seen that side surfaces 26, 28 diverge on progressing upwardly at an angle "B" which is at least as great as angle "A" of the lower portion. Angle "B" is referred to herein as a second angle and preferably is in a range from 12° to 90°.

Edges 20, 22 intersect their associated side surfaces 26, 28, respectively, intermediate the ends of the device and intermediate side surfaces 32, 34 and 36, 38. As is best seen in FIG. 3, the region of intersection between edges 20, 22 and their associated side surfaces 26 28, respectively, is in the lower half of the device.

Opposed edges 16, 18 on the major axis of the diamond shape of the lower portion diverge on progressing upwardly at an angle greater than angle "A" between edges 20, 22. These edges extend upwardly beyond the region of intersection between edges 20, 22 and side surfaces 26, 28 to a region adjacent the upper end of the device. They thereby form an upwardly extending continuation of at least a portion of the diamond-shaped configuration found in the lower portion of the device. They provide side extensions 40, 41 adjacent the upper end of the device which project laterally outwardly to opposite sides of side margins 32, 34, 36, 38 to provide a portion of the broad striking expanse at the upper end of the device, as well as participate in cleavage plane development.

The device has serrations, or notches, 42 formed on edges thereof to act as gripping means to faciliate holding the device in an object to be split.

Figure 1:
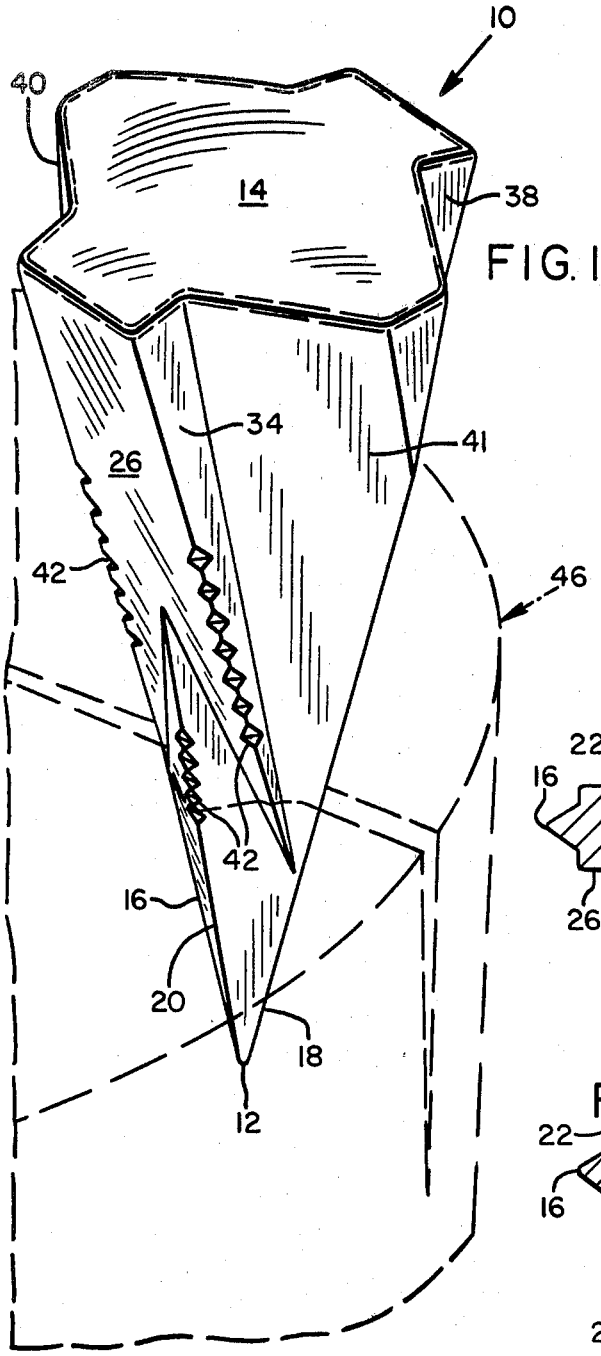
FIG. 1 is a top perspective view of the device partially imbedded in a log (shown in phantom outline)

FIG. 1 illustrates, in phantom outline, a log 46, in the upper end of which device 10 has been imbedded. The pointed lower end permits the device to be easily imbedded to stand upright, allowing the user to strike it with full-force blows upon its broad striking surface 14. As the lower diamond-shaped portion penetrates the log, it produces a cleavage plane. As the device is driven further into the log, side surfaces 26,28 come into play to engage the sides of the cleavage for greater efficiency and completion of splitting.

Although a preferred embodiment of the invention has been described herein, it should be apparent to those skilled in the art that variations and modifications are possible without departing from the spirit of the invention.

I claim:

1. An elongate unitary splitting device comprising a substantially pointed first end, a lower portion adjacent and extending upwardly from said first end, said lower portion being multiangular with a plurality of edges, at least a pair of opposed edges thereof diverging from each other at a first angle on progressing upwardly from said first end, and an upper portion having a pair of generally planar, oppositely facing side surfaces, said side surfaces being intersected intermediate the ends of said device by said opposed edges, with said side surfaces diverging on progressing upwardly from the region of intersection at a second angle at least as great as said first angle.

2. An elongate unitary splitting device comprising a substantially pointed first end, a lower portion adjacent and extending upwardly from said first end, said lower portion being multiangular with a plurality of edges, at least a pair of opposed edges thereof diverging from each other at a first angle on progressing upwardly from said first end, and an upper portion having a pair of generally planar, oppositely facing side surfaces, said side surfaces being intersected intermediate the ends of said device by said opposed edges, with said side surfaces diverging on progressing upwardly from the region of intersection at a second angle at least as great as said first angle, a side surface being bordered by a pair of substantially parallel, oppositely facing side margins extending longitudinally of said device.

3. The device of claim 2, wherein one of said opposed edges intersects its associated side surface intermediate said side margins.

4. The device of claim 2, which further comprises gripping means thereon to facilitate holding said device in an object to be split.

5. The device of claim 4, wherein said gripping means comprises serrations formed on edges thereof.

6. The device of claim 2, wherein the end of the device opposite said first end defines a broad expanse adapted to receive a striking force from a maul independent of said device.

7. The device of claim 2, wherein said upper portion further includes side extensions adjacent the end opposite said first end, which extensions project laterally outwardly to opposite sides of said side margins to define a broad striking expanse at said opposite end.

8. The device of claim 2, wherein said second angle is greater than said first angle.

9. The device of claim 8, wherein said first angle is in a range of 10° to 30° and said second angle is in a range from 12° to 90°.

10. The device of claim 2, wherein said region of intersection is in the lower half of said device.

11. An elongate unitary splitting device comprising a substantially pointed first end, a lower portion of substantially diamond-shaped cross section having major and minor axes with opposed edges on said minor axis, which edges diverge at a first angle on progressing upwardly from said first end, and an upper portion having a pair of generally planar, oppositely facing side surfaces, said surfaces being intersected intermediate the ends of said device by said opposed edges with said side surfaces diverging on progressing upwardly from the region of intersection at a second angle at least as great as said first angle.

12. An elongate unitary splitting device comprising a substantially pointed first end, a lower portion of substantially diamond-shaped cross section having major and minor axes with opposed edges on said minor axis, which edges diverge at a first angle on progressing upwardly from said first end, and an upper portion having a pair of generally planar, oppositely facing side surfaces, said surfaces being intersected intermediate the ends of said device by said opposed edges with said side surfaces diverging on progressing upwardly from the region of intersection at a second angle at least as great as said first angle, a side surface being bordered by a pair of substantially parallel, oppositely facing side margins extending longitudinally of said device.

13. The device of claim 12, wherein an edge intersects its associated side surface intermediate said side margins.

14. The device of claim 12, which further comprises gripping means thereon to facilitate holding said device in an object to be split.

15. The device of claim 14, wherein said gripping means comprises serrations formed on edges thereof.

16. The device of claim 12, wherein the end of the device opposite said first end defines a broad expanse adapted to receive a striking force from a maul independent of said device.

17. The device of claim 12, wherein said upper portion further includes side extensions adjacent the end opposite said first end, which extensions project laterally outwardly to opposite sides of said side margins to define a broad striking expanse at said opposite end.

18. The device of claim 12, wherein said second angle is greater than said first angle.

19. The device of claim 18, wherein said first angle is in a range of 10° to 30° and said second angle is in a range from 12° to 90°.

20. An elongate unitary splitting device comprising a lower portion having a substantially diamond-shaped cross section as viewed along the longitudinal axis of the device, which portion converges to a point at the lower end of the device, said section having major and minor axes with opposed edges